United States Patent [19]

Weinheimer

[11] Patent Number: 4,661,663

[45] Date of Patent: Apr. 28, 1987

[54] TILT SWITCH

[76] Inventor: Francis P. Weinheimer, 501-TA Oaklyn Ct., Pittsburgh, Pa. 15220

[21] Appl. No.: 786,598

[22] Filed: Oct. 11, 1985

[51] Int. Cl.[4] ..... H01H 35/02

[52] U.S. Cl. ..... 200/61.21; 174/108; 198/524; 200/61.47; 340/617

[58] Field of Search ..... 200/52 R, 61.47, 61.21, 200/215, 216, 302.1, 302.2, 302.3; 198/524; 340/617; 174/76, 36, 108

[56] References Cited

U.S. PATENT DOCUMENTS

| | | | |
|---|---|---|---|
| 1,824,904 | 9/1931 | Kulicke | 174/108 |
| 2,442,275 | 5/1948 | Mayer | 200/61.21 |
| 2,814,703 | 11/1957 | Martin | 200/302.2 |

*Primary Examiner*—A. D. Pellinen
*Assistant Examiner*—Morris Ginsburg
*Attorney, Agent, or Firm*—Carothers & Carothers

[57] ABSTRACT

A novel suspended tilt switch method and apparatus for use in transporting bulk material and including a switch assembly having a plurality of parallel connected, position sensitive switch elements mounted in a predetermined configuration to provide normally open operation with actuation of the tilt switch by closing of the contacts of at least one switch element upon tilting of the switch structure in any direction from vertical to a predetermined actuation angle, and further a novel unitary tilt switch hanger which encases the electrical conductors extending from the switch to protect the conductors continuously from the switch to the connected controller.

11 Claims, 5 Drawing Figures

TILT SWITCH

BACKGROUND OF THE INVENTION

This invention pertains to a tilt switch apparatus and method, especially for use in bulk material handling such as is required for removal of coal from underground mines.

In the mining arts, it is well known that a tip or tilt switch may be utilized to detect any of a variety of conditions such as a skewed conveyor belt, an overfilled hopper, or a plugged feed chute.

Typically, the known tilt switch apparatus for such purposes may comprise a switch housing that hangs vertically from a flexible support such as a chain within the confines of a power fed coal bin, for example. An electrical cable, which is separate from the switch hanger, connects a single tilt switch element such as a mercury switch within the switch housing to a control circuit for control of the feeder that delivers coal to the bin. If the feeder delivers the coal at a greater rate than it is being removed from the bin, the coal level in the bin will rise until the switch is tilted sufficiently from vertical to actuate the switch element contacts and turn off the feeder, thus preventing an over-fill condition in the bin.

Typical examples of such prior switches are the products of Ramsey Engineering Company and American Mine Research, Inc., and specifically Tip Switch Model TS1900 of the latter. Other prior art motion or position sensitive switches known to applicant include those discussed in U.S. Pat. Nos. 3,657,695, 3,362,023, 4,163,127, 3,030,477, 4,156,236, and 4,450,325.

The prior tip switches known to the applicant herein have incorporated only a single, normally closed switch element such as a mercury switch, and have been provided with separate switch hanger and electrical power feed arrangements. Often there have been problems with interference between the switch hanger structure and the electrical cable, as well as with extreme and rapid wear and premature failure of the electrical cable, especially in underground mining environments. Thus it may be seen that the prior art tip switches have been subject to various undesirable limitations regarding electrical cable durability, hanger integrity, and reliability of operation.

Another shortcoming of the prior art is that tip switches commonly have been utilized in mines only to exert control upstream from the problem area. For example, conventionally when a tip switch responds to an over-fill condition in a bin, it operates to discontinue the feed of material to the bin. Although this response may be effective to prevent further aggravation of the over-fill condition, it does not alleviate the condition. Thus, the conventional tip switch function has been of limited value. The use of tip switches exclusively for this sort of control function in the prior art is related to the relative desirability of normally closed versus normally open switch contacts. In some applications, using a switch with normally closed contacts is not desirable where the control circuitry is not designed to accept this type of input. The alternative is a tip switch provided with a special, normally open switch element that closes upon actuation to complete a circuit.

Although such switch elements are known, they have not been practical for application in a tilt switch that must actuate upon tilting to a specified angle in any direction.

BRIEF SUMMARY OF THE INVENTION

The present invention contemplates a novel tilt switch structure and method of operation which provides, in an economical structure, a switch that provides for normally open contacts when hanging vertically and closing of the contacts when the switch is tilted in any direction from vertical through a predetermined angle which is equivalent to the typical actuation angle of conventional tilt switches. The structure thus affords an economical, normally open tilt switch which is compatible with the control circuitry most commonly found in underground mining installations. The switch thus may be utilized to energize an apparatus to alleviate the switch actuating condition, rather than merely avoiding aggravation of the condition. Because of its compatibility with conventional control circuitry, the novel switch of this invention does not rely on special purpose relays, special design tilt switch elements, or other unduly expensive additional circuit elements. The novel switch structure specifically includes a plurality of position responsive switch elements which are oriented at different angles about the vertical axis of an elongated switch body. The switch elements all operate as normally open switches and are parallel wired whereby the closing of contacts in any one of the plural switch elements will complete control circuit. By the mode of switch operation provided, a novel method of handling and/or transporting bulk material is also realized.

Additional features of the novel tilt switch method and apparatus of this invention include greatly enhanced durability, life expectancy, and reliability owing in part to a novel and improved hanger and electrical cable connection arrangement, as well as the manner of mounting of the tilt switch elements within the switch housing.

Accordingly, it is one primary object of this invention to provide a novel and improved tilt switch apparatus.

Another primary object of the invention is to provide a novel method of bulk material handling equipment control.

A more specific object of the invention is to provide a novel tilt switch of enhanced simplicity, durbility and realibility and which is able to perform specialized control functions.

These and other objects and further advantages of the invention will be more readily understood upon consideration of the following detailed description and the accompanying drawings, in which.

Figure 1:
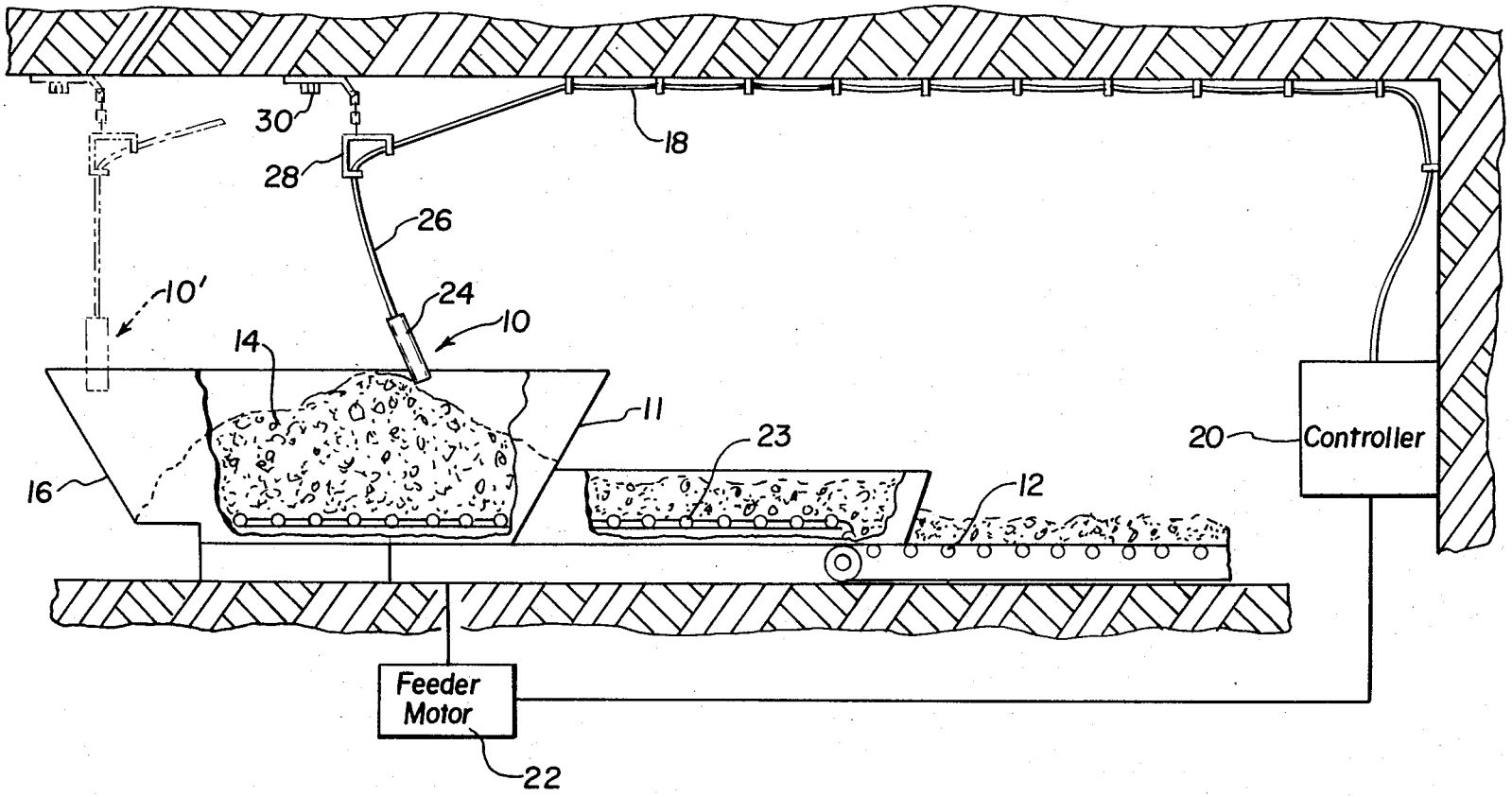
FIG. 1 is a schematic depiction of a coal mine belt conveyor head and feeder trough showing utilization of the tilt switch of this invention according to applicant's novel method.

There is generally indicated at 10 in FIG. 1 a tilt switch constructed and used according to one presently preferred embodiment of the instant invention in conjunction with a feeder 11 for actuating a flighted feeder conveyor 23 in response to the level of the contents or load 14 (coal for example) being fed into the bin or trough 16 of feeder 11, which is located at the head end of a main haulage belt conveyor 12. Such conveyor or feed trough arrangements are well known in the mining arts and are widely used, for example, for coal haulage in underground mines, where the trough 16 receives the coal loads of shuttle cars that carry the coal from the mine face.

As shown, a load of coal in trough 16 will cause tilt switch 10 to be displaced angularly from its normal vertical hanging position. At a sufficient predetermined angle of tilt, the switch contacts are closed to provide an actuating signal via an electrical cable 18 to a controller 20 which controls motor 22 of flighted conveyor 23. In response, the motor 22 is energized for a predetermined time period by means of a timer (not shown) and feeder conveyor 23 feeds coal from trough 16 to continuously running belt conveyor 12 to thereby remove coal from the trough 16. As the load level in trough 16 is thus reduced, switch 10 returns to its normal vertical hanging position and the switch contacts open to await another load. If the load is not removed through continuing timed operation of conveyor 23, then actuation of switch 10 automatically re-energizes the timer to re-start motor 22. This eliminates the need for the shuttle car operator's presence for manual actuation of the system.

Of course, it will be understood that motor 22 and controller 20 may typically be carried by feeder 11, and that the representations thereof in FIG. 1 are schematic representations only.

Switch 10 comprises an elongated cylindrical body 24 that hangs from the ceiling of the mine, or alternatively from any suitable overlying structure such as an upstanding portion of the feed trough frame (not shown) by a vertical length 26 of the electrical cable 18. As shown, the switch body 24 is suspended by a hanger structure 28 which retains the upper end of electrical cable portion 26 and is in turn retained adjacent the mine roof as by a chaing and a bolt 30 embedded in the roof.

Figure 2:
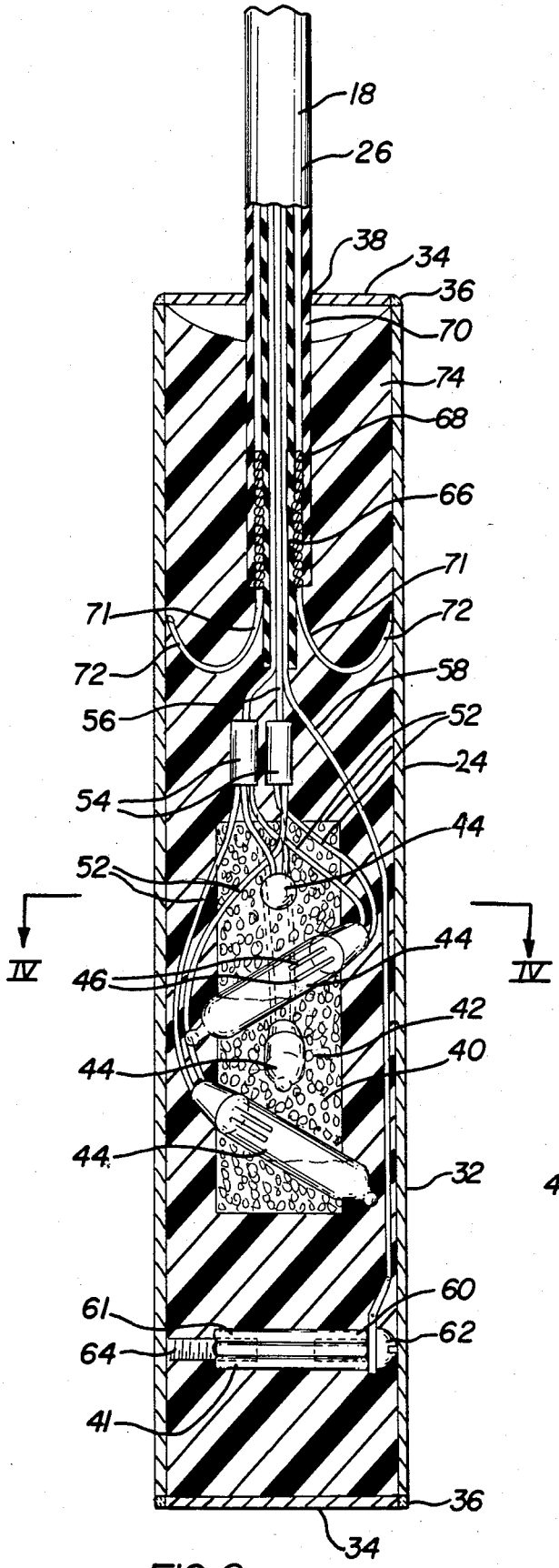
FIG. 2 is a transverse section of a tilt switch of this invention.

As shown in FIG. 2, switch 10 comprises the body 24 suspended by vertical portion 26 of cable 18. Body 24 is formed as an elongated open ended cylindrical member 32, a suitable length of steel or malleable iron pipe for example, which may have its opposite ends sealed by end caps 34 permanently affixed in place as by continuous circumferential weldments 36. If the end caps 34 are used, the upper end cap 34 will include a central aperture 38 to receive the free end of cable portion 26. Accordingly, the upper end cap 34 may be a steel washer, for example. For non-permissible usage, (i.e., use in non-gassy areas-typical), the upper end cap would be eliminated and the lower end cap replaced by a rubber stopper.

Within the confines of body 24 is disposed a switch assembly 40, a ground connector assembly 41, and connections of these to the conductors of cable 18. Switch assembly 40 comprises a switch element retention member such as a plastic block 42 of pelletized polystyrene or a foamed plastic material, for example, which is provided with apertures to receive a plurality of position sensitive switch elements, four mercury switches 44 for example, that preferably are positioned such that the switch contacts are normally open when switch body 24 hangs vertically. Specifically, the switch elements 44 are stacked vertically within the length of retention member 42 and each one angles downwardly at an angle of, for example, approximately 45° for a switch using a glass enclosed type mercury tube switch such as a Microswitch Model No. AS417B2 but not limited to this particular switch. Additionally, the four switch elements, 44 are positioned radially with respect to the axis of body 24 approximately at 90° intervals such that tilting of body 24 in any direction from vertical to the specified angle will close the contacts 46 of at least one switch element 44.

Figure 4:
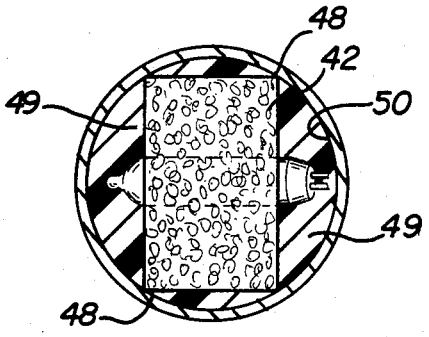
FIG. 4 is a transverse section taken on IV—IV of FIG. 2.

As shown in FIG. 4, polystyrene block 42 is preferably of a rectangular cross-section or other suitable section to permit portions of opposite sides 48 of block 42 to engage the interior side walls 50 of body 24 to thereby retain switch elements 44 within body 24 and to locate them at positions spaced from the interior side walls 50 thereof. The remaining sides 49 of block 42 provide clearance within body 24 for filling the interior of the body 24 with potting compound as will be described.

The respective conductors 52 of each switch element 44 are brought together and connected in parallel by means of a butt connector 54 to a corresponding conductor 56 of cable 18.

A third conductor 58 of cable 18 is a ground conductor which extends within body 24 for connection to ground connection assembly 41. The assembly 41 comprises an elongated coupling nut 60 that receives a screw 62 in one end thereof to connect ground conductor 58 thereto, and a threaded post 64 in the opposite end thereof. Nut 60 is provided with a hex shaped exterior surface 61 to permit engagement thereof by a common crescent wrench (not shown) for rotating nut 60 with respect to post 64 to thereby extend post 64 outward until assembly 41 extends between and is tightly engaged in electrical contact (not shown) with the interior sidewalls 50 of body 24. Another entirely suitable mode of ground connection may be achieved by connecting ground conductor 58 to a screw and nut through a hole in the sidewall 50 of body 24.

Figure 3:
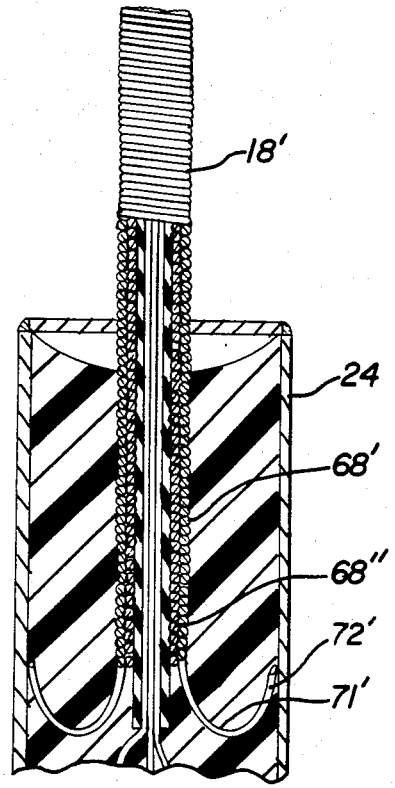
FIG. 3 is a fragmentary section similar to FIG. 2 of an alternative embodiment of the invention.

Cable 18 is an armored cable having the insulated conductors 56 and 58 thereof sheathed in an insulation belt 66, which is in turn sheathed within a continuous shield of helically wound wire armor 68, preferably a 24 strand wire winding. Armor shield 68 is in turn sheathed in an exterior insulation jacket 70 or as shown in FIG. 3, an inner shield 68'' may be sheathed in a similar outer shield 68'. The free end of cable 18 in body 24 has strands 71 of the wire armor 68 bent and positioned such that they are distributed circumferentially about the cable 18. The extreme ends 72 of strands 71 are bent radially outward and back on themselves preferably in proximity to or in engagement with the sidewalls 50 to provide a tight, high strength mechanical connection of cable 18 within body 24 as will be described.

To provide a unitized switch assembly which is dust tight, water proof and shock proof, body 24 is filled with any suitable potting compound 74, preferably an epoxy compound such as conathane EN-2521. The epoxy is poured into the top of body 24 after installation of the cable 18, the connected switch assembly 40 and ground connector assembly 41 within body 24, and after installation of lower end cap 34 or other suitable temporary or permanent closure to keep the potting compound in place until it sets. If upper end cap 34 is used, it is received about cable 18 but is not in place on body 24 prior to pouring of the potting compound. When compound 74 is poured into body 24, it passes between the individual strands 71 of armor 68 and through the clearance between sides 49 of block 42 and the inner sidewall 50 of body 24. Thus, the compound 74 fills the entire unoccupied volume within body 24 to embed all of the above described switch components therein.

The back-bent form of armor strands 71, which are embedded in potting compound 74, provides a high strength mechanical connection to withstand all mechanical loads that will be imposed on the switch suspension structure in service. Accordingly, armor 68 serves as a tension hanger element for the switch while the electrical conductors extending therein provide the electrical connections to the switch from the related control circuitry. Since the conductors are thus encased within an armored shield continuously from the switch to the control circuitry which the switch actuates, they are well protected from wear and abrasion. This is particularly important in the hanger portion 26 of cable 18 as the conductors therein would otherwise be subject to extreme wear due to repeted dumping of coal into trough 16, and resultant scraping and abrasion of cable portion 26 by the coal load.

In the alternative cable retention configuration (FIG. 3) cable 18' may comprise a double shielded cable having a pair of 24 strand armor windings 68', 68'' which are helically wound in opposite directions. For this embodiment, the outer armor jacket 68' replaces the outer insulation jacket 70 of the FIG. 2 embodiment, and thus the outer armor jacket 68' is exposed throughout the length of the cable 18'. Further, for the FIG. 3 embodiment, only the strands 71' of the outer armor jacket 68' are positioned radially about cable 18' and have their ends 72' bent outwardly and back upon themselves. Thus, armor 68' functions in a fashion entirely similar to armor jacket 68 of FIG. 2 to provide a high strength mechanical connection between cable 18' and body 24.

It is repeated here for emphasis that the strength of the cable armor and of the connection thereof in the switch body is sufficient that no additional hanger element such as a chain is required. The switch thus is suspended and electrically connected for its specified control function though a single, unitary suspension conduit which shields the electrical conductors continuously between the switch and the controller. The shield also functions as a tension bearing element to bear the hanging weight of the switch as well as all forces to which the switch may be subjected in use.

Figure 5:
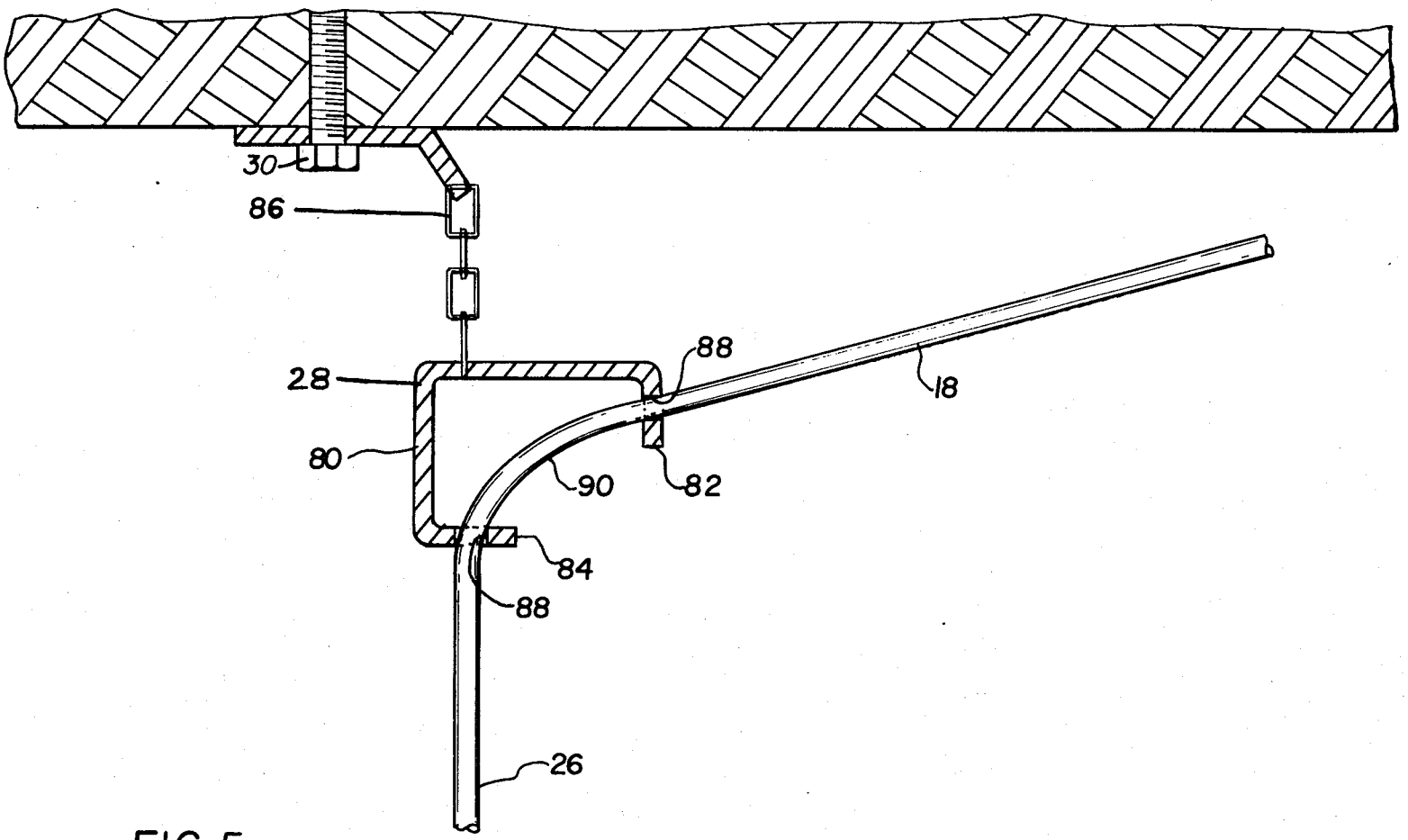
FIG. 5 is a sectioned, side elevation of the cable hanger of FIG. 1.

Hanger structure 28 (FIG. 5) preferably comprises a rigid angular bracket 80 of steel or the like having inturned ends 82, 84 positioned at right angles relative to each other. Bracket 80 is suspended, from the mine roof for example, by a chain 86 connected to a roof plate and a bolt 30. An aperature 88 in ech inturned end 82, 84 is sized to receive cable 18, which is fed therethrough so as to form an arc 90 between the apertures 88. Because of the construction of cable 18 as above described, and especially due to the helically wound wire shield, cable 18 is stiff and springy enough that an inherent and continuous straightening bis in the arc portion 90 serves to securely lock the cable 18 in position. The bracket thus serves to securely hang switch 10 by cable 18, and to provide for a smooth transition of the stiff cable 18 from a vertical run to a horizontal run.

For adjustment of cable 18 in bracket 80, it is necessary only to push arc portion 90 as to bend it further. This manual bending bias partially offsets the inherent tendency of the cable to straighten, and thus release the grip of apertures 88 upon cable 18 for easy adjustment thereof.

The method of bulk material handling according to the present invention is embodied in the above description; however, for purposes of emphasis, it is noted that when plural tilt switch elements have been provided as above described for tilting in unison upon tilting of their common switch housing in any direction, the contacts of at least one switch element will close upon reaching the specified minimum angle of tilt of 45°. As the switch elements are wired in parallel, closing the contacts of any one or more of the switches will provide the requisite actuating signal to the feeder controller. The actuating signal is thus provided when a load of coal (i.e. from an independently operated shuttle car) is deposited in trough 16 and displaces switch 10 to the side through an angular displacement of 45° from vertical for example, thus tilting it sufficiently to actuate feeder motor 22 whereby the feeder removes coal from trough 16 and deposites it on conveyor 12. After a predetermined time, and when the coal load level in trough 16 reaches a predetermined low level and no longer diplaces the switch to its minimum actuation angle ot tilt, the feeder motor is de-energized until a further load of coal is deposited in trough 16 to again actuate the tilt switch.

Preferably, the switch 10 is located with respect to the input end of trough 16 (the left end as viewed in FIG. 1) such that the load of an incoming shuttle car will actuate the tilt switch 10 and thereby assure that conveyor 23 will be running before the shuttle car begins to off-load its load to coal. This will eliminate the potentially damaging strain of trying to start the conveyor 23 under heavy load. To accomplish this, switch 10 may be located toward the left end of trough 16, for example, as shown at 10' in FIG. 1.

The invention described hereinabove concerns novel method and apparatus for bulk material handling to provide automatic material feed from a bin or container in response to the level of the bin contents. Of course, it will be understood that the above description pertains to certain presently preferred embodiments of the invention, and that numerous modifications and refinements have been envisioned by the inventor. For example, the swtich disclosed may use either n.o. or n.c. refinment and be either of standard or explosion-proof construction; specific details of switch element and ground connection structure and mounting may be varied within a latitude of design considerations consistent with the description hereinabove; and the like. These and other modifications and alternative embodiments having been envisined and anticipated by the inventor, it is intended that the invention be construed broadly and limited only the scope of the claims appended hereto.

I claim:

1. A hanging tilt switch apparatus which is adapted to hang from an overlying structure to provide an actuating signal in response to angular displacement thereof from a hanging rest position for actuation of a remote apparatus, said tilt switch apparatus comprising:

a hollow switch body member;

tilt switch means carried within said body member;

a quantity of potting compound filling at least a portion of said body member;

suspension cable means having a free end extending into said body member and embedded within said potting compound;

said suspension cable means being adapted to extend from said body member to such a remote apparatus;

said suspension cable means comprising electrical conductor means connected to said tilt switch means and extending intermediate the hollow interior of said body member and such a remote apparatus, and a shield means continuously encompassing said electrical conductor means;

said shield means at least adjacent said free end thereof being a multiple strand wire shield with selected ones of said strands being formed to extend radially outwardly of said suspension cable means within said potting compound for retention thereof within the hollow interior of said body member whereby said shield means provides support for said body member and continuously shields said electrical conductor means between said body member and such a remote apparatus.

2. The tilt switch apparatus as claimed in claim 1 wherein said tilt switch means includes a plurality of tilt switch elements and retention means for positioning said plurality of switch elements with respect to one another and with respect to said body member.

3. The tilt switch apparatus as claimed in claim 2 wherein said retention means positions said plurality of switch elements in spaced relationship with respect to interior sidewall portions of said body member which define the hollow interior of said body member.

4. The tilt switch apparatus as claimed in claim 3 wherein said retention means is a retention block having means for retention of said plurality of switch elements therein and means for engagement with said interior sidewall portions of said body member.

5. The tilt switch apparatus as claimed in claim 4 additionally including ground connector means electrically engaging said interior sidewall portions and electrically connected to one of said electrical conductor means.

6. The tilt switch apparatus as claimed in claim 6 wherein said shield means is helically wound wire shield.

7. The tilt switch apparatus as claimed in claim 6 wherein said selected include end portions which are further formed in a U-shaped configuration with said end portions being disposed adjacent said interior sidewall portions of said body member.

8. The tilt switch apparatus as claimed in claim 7 wherein said shield means is a multiple layer helically wound wire shield with selected layers thereof being wound in opposite directions.

9. The tilt switch apparatus as claimed in claim 8 wherein only strands of the outermost layer of said wire shield are formed to provide said retention.

10. The tilt switch apparatus as claimed in claim 1 additionally including cable securing means retaining said suspension cable means intermediate the ends thereof and in turn adapted to be secured to such an overlying structure to support said suspension cable means for suspension of said body member from such an overlying structure.

11. The tilt switch apparatus as claimed in claim 10 wherein said securing means includes a backet mens adapted to be secured to such an overlying structure and which includes a pair of spaced apart apertures positioned on substantially mutually perpendicular axes, said aperatures receiving said suspension cable means in a manner to maintain said cable means in a generally arcuate configuration therebetween to adjustably retain said cable means with respect to said securing means.

* * * * *